US012134011B1

(12) United States Patent
Araujo et al.

(10) Patent No.: US 12,134,011 B1
(45) Date of Patent: Nov. 5, 2024

(54) GOLF BALL HAVING AN INTERLOCKING MULTI-LAYERED CORE

(71) Applicant: Acushnet Company, Fairhaven, MA (US)

(72) Inventors: Nelson J. Araujo, South Dartmouth, MA (US); Edward Costa, East Providence, RI (US)

(73) Assignee: Acushnet Company, Fairhaven, MA (US)

( * ) Notice: Subject to any disclaimer, the term of this patent is extended or adjusted under 35 U.S.C. 154(b) by 60 days.

(21) Appl. No.: 18/317,141

(22) Filed: May 15, 2023

(51) Int. Cl.
*A63B 37/04* (2006.01)
*A63B 37/00* (2006.01)
*A63B 37/06* (2006.01)

(52) U.S. Cl.
CPC ..... *A63B 37/0051* (2013.01)

(58) Field of Classification Search
CPC ..... A63B 37/0004; A63B 37/005; A63B 37/0055
See application file for complete search history.

(56) References Cited

U.S. PATENT DOCUMENTS 696,354 A * 3/1902 Richards ..... B32B 37/10 156/146
699,632 A * 5/1902 Richards ..... B29C 45/1418 425/173
707,595 A * 8/1902 Kempshall ..... B29C 31/00 156/186
711,508 A * 10/1902 Kempshall ..... A63B 37/0097 473/355
780,582 A * 1/1905 Richards ..... A63B 37/0097 473/355
790,398 A * 5/1905 Richards ..... B29C 31/00 156/186
790,954 A * 5/1905 Davis ..... A63B 37/0097 473/355
1,255,388 A * 2/1918 Cobb ..... A63B 37/0097 473/355
1,483,165 A * 2/1924 Washington ..... A63B 69/3655 D30/160
1,855,448 A * 4/1932 Hazeltine ..... A63B 37/0009 473/377

(Continued)

FOREIGN PATENT DOCUMENTS

JP 2004121565 A * 4/2004
KR 20040074192 A * 8/2004

(Continued)

*Primary Examiner* — Alvin A Hunter
(74) *Attorney, Agent, or Firm* — Steven Landolfi, Jr.

(57) ABSTRACT

A golf ball has a core and a cover that surrounds the core. The core is a multi-layer component of the golf ball, having at least two core layers including an inner core and at least one outer core. The inner core is formed from a first composition and has a generally spherical shape and a spherical surface. The inner core defines one or more through holes that each extend from a first opening at the spherical surface to a second opening at the spherical surface. The outer core is formed from a second composition, different from the first composition. The outer core has a first portion that surrounds the inner core and a second portion that extends from the first opening to the second opening and thereby completely fills each of the through holes.

20 Claims, 6 Drawing Sheets

(56) References Cited

U.S. PATENT DOCUMENTS 2,210,954 A * 8/1940 Roberts ..... B29D 22/04 156/213
2,211,330 A * 8/1940 Hochberg ..... A63F 7/0005 D11/131
2,597,704 A * 5/1952 Carlson ..... B29C 66/1142 156/252
2,953,922 A * 9/1960 Bonkowski ..... A63B 69/3655 473/200
3,331,605 A * 7/1967 Special ..... A63B 37/0003 273/DIG. 20
3,908,994 A * 9/1975 Astrom ..... A63B 43/00 473/613
4,006,908 A * 2/1977 Minami ..... A63B 43/00 473/200
4,121,828 A * 10/1978 Amburgey ..... A63B 37/10 473/126
4,305,583 A * 12/1981 Tandon ..... A63B 45/00 473/609
5,033,743 A * 7/1991 Wright ..... A63B 43/00 273/DIG. 20
6,012,997 A * 1/2000 Mason ..... A63B 43/00 273/DIG. 20
6,045,454 A * 4/2000 Chu ..... A63B 69/3655 473/368
6,102,815 A * 8/2000 Sutherland ..... A63B 37/0097 473/371
6,213,893 B1 * 4/2001 Maruko ..... A63B 37/0045 473/370
6,398,667 B1 * 6/2002 Lemons ..... A63B 37/12 473/376
6,595,875 B1 * 7/2003 Oh ..... B32B 5/16 473/373
6,773,363 B2 * 8/2004 Sullivan ..... A63B 37/0097 473/355
6,991,561 B2 1/2006 Nesbitt et al.
7,232,382 B2 * 6/2007 Kennedy, III ... A63B 37/00221 473/354
9,114,283 B2 * 8/2015 Kennedy, III ..... B29C 45/1675
9,592,426 B1 * 3/2017 DiPietro ..... A63B 37/0056
9,782,632 B1 * 10/2017 Breaker ..... A63B 37/0003
10,695,617 B1 * 6/2020 Madson ..... A63B 37/08
2001/0031668 A1 * 10/2001 Sullivan ..... A63B 37/0009 473/354
2002/0086746 A1 * 7/2002 Bellinger ..... A63B 37/0097 473/378
2002/0091017 A1 * 7/2002 Kuesters ..... A63B 71/06 473/407
2002/0132684 A1 * 9/2002 Sullivan ..... A63B 37/02 473/355
2002/0173378 A1 * 11/2002 Tinsman ..... A63B 43/00 473/351
2003/0013549 A1 * 1/2003 Rajagopalan .... A63B 37/00922 473/378
2003/0228935 A1 * 12/2003 Sullivan ..... A63B 37/0055 473/355
2005/0197211 A1 * 9/2005 Sullivan ..... A63B 37/0003 473/371
2007/0287558 A1 * 12/2007 Sullivan ..... A63B 37/0003 473/374
2009/0215554 A1 * 8/2009 Cheng ..... A63B 37/005 473/376
2012/0214614 A1 * 8/2012 Miyata ..... A63B 37/00622 473/378
2013/0203520 A1 * 8/2013 Poe ..... A63B 69/36 473/226
2017/0050087 A1 * 2/2017 Sullivan ..... A63B 37/0063
2017/0291077 A1 * 10/2017 Madson ..... A63B 37/0055
2018/0318657 A1 * 11/2018 Madson ..... A63B 37/0058
2020/0215395 A1 * 7/2020 Madson ..... A63B 37/0058

FOREIGN PATENT DOCUMENTS

KR 620795 B1 * 9/2006 ..... A63B 37/0003
KR 100620795 B1 * 9/2006
KR 2021097927 A * 8/2021 ..... A63B 37/0011
WO WO-9934881 A2 * 7/1999 ..... A63B 37/0075
WO WO-0137944 A1 * 5/2001 ..... A63B 37/0005
WO WO-2005011819 A1 * 2/2005 ..... A63B 37/0003
WO WO-2005120651 A1 * 12/2005 ..... A63B 37/0003

* cited by examiner

GOLF BALL HAVING AN INTERLOCKING MULTI-LAYERED CORE

FIELD OF THE INVENTION

The present disclosure generally relates to golf balls and golf ball cores, and, in particular, golf balls having interlocking multi-layered cores.

BACKGROUND OF THE INVENTION

Today, both professional and amateur golfers alike use multi-piece, solid golf balls. For example, in a two-piece solid golf ball construction, a solid core is typically protected by a cover. The core is often made of a natural or synthetic rubber such as polybutadiene, styrene butadiene, or polyisoprene. In turn, the cover may be formed from of a variety of materials such as ethylene acid copolymer ionomers, polyamides, polyesters, polyurethanes, and/or polyureas.

Three-piece, four-piece, and even five-piece golf balls became more popular with the development of manufacturing technologies for efficiently producing same. Multi-layered cores may be comprised, for example, of an inner core containing a relatively soft and resilient material, surrounded by an outer core layer made of a harder and more rigid material. This "dual-core" sub-assembly is then encapsulated by at least one layer such as single or multi-layered cover layer, and optionally one or more intermediate layers to complete the golf ball construction.

Meanwhile, golf ball manufacturers pre-select the materials for each layer to target and impart desirable improved golf ball playing/performance properties/characteristics cost effectively. Currently, a broad range of options are available for strategically incorporating and coordinating layers within each golf ball construction. In multi-layered golf balls, each of the core, intermediate layer and cover can be single or multi-layered, and properties such as hardness, compression, resilience, specific gravity, corm diameter, intermediate layer thickness and cover thickness can be preselected and coordinated to target play characteristics such as spin, initial velocity and feel of the resulting golf ball.

In particular, the core is an important part of any golf ball because it acts as an engine or spring for the golf ball. Therefore, golf ball manufacturers continue to improve a core's construction and composition, which are key factors in targeting the resiliency and rebounding performance of the ball.

In this regard, golf ball manufacturers have previously adjusted/modified core properties by dispersing processing aids, fillers, and/or particulates throughout the entire core composition. Additionally, hardness gradients have been created in cores by adjusting the cure profile of the core composition so that core hardness can increase and/or decrease from the core's geometric center radially outward toward its outer surface. In yet other golf ball constructions, property gradients have been created by exposing the core's outer surface to a surface penetrating solution/composition which modifies the properties of the outer surface relative to the remaining portion of the core that is not exposed to the surface penetrating solution/composition.

However, it is important that modifications to the core do not negatively impact flight symmetry. Flight symmetry is achieved when a golf ball flies at substantially the same height and distance, and remains in flight for substantially the same period of time, regardless of how it is placed on the tee. Without flight symmetry, "hooking" or "slicing" can occur when the golf ball is in flight after being struck by a golf club face. An unbalanced core can also cause the golf ball to roll out of alignment during putting on the course.

Accordingly, there is a need for unique golf balls incorporating novel core constructions that promote core concentricity of the multiple core layers such that the core does not sacrifice golf ball flight symmetry and/or putting trajectory. Disclosed golf balls and methods of making same address and fulfill this need.

SUMMARY OF THE INVENTION

In one aspect, the present disclosure includes a golf ball including a core and a cover surrounding the core. The core includes an inner core and at least one outer core. The inner core is formed from a first composition and has a generally spherical shape and a spherical surface. The inner core defines one or more through holes that each extend from a first opening at the spherical surface to a second opening at the spherical surface. The outer core is formed from a second composition, different from the first composition. The outer core has a first portion that surrounds the inner core and a second portion that extends from the first opening to the second opening and thereby completely fills each of the through holes.

In another aspect, the present disclosure includes a method of making a golf ball. The method includes molding an inner core in the shape of a sphere having a spherical surface, forming a through hole into the inner core, the through hole being a hollow channel having a first opening in the spherical surface connected to a second opening in the spherical surface, molding and curing an outer core onto the inner core such that the material making up the outer core flows into the through hole and completely fills the through hole with the material, and forming a cover around the outer core and the inner core, the cover including a plurality of dimples. In some embodiments, the first opening is at a first pole of the sphere and the second opening is at an opposite pole of the sphere such that the through hole passes through a core center point of the sphere. In some embodiments, the material making up the outer core comprises a composition having a base rubber and having a Mooney viscosity between about 30 and about 60.

In another aspect, a method of making a golf ball also includes forming a second through hole in the inner core such that molding and curing the outer core causes the material making up the outer core to flow into and fill the second through hole with the material.

In another aspect, a method of making a golf ball also includes forming an intermediate layer that is between the outer core and the cover, wherein the intermediate layer is a second outer core, a casing layer, or a second cover layer.

In another aspect, the present disclosure includes a golf ball. The golf ball includes a core and a cover surrounding the core. The core includes an inner core, a first outer core, and a second outer core. The inner core is formed from a first composition and has a generally spherical shape and a spherical surface. The inner core defines at least one through hole that extends from a first opening at the spherical surface to a second opening at the spherical surface. The first outer core is formed from a second composition, different from the first composition. The second outer core is formed from a third composition, different from the second composition. The first outer core surrounds the inner core and the second outer core surrounds the first outer core and the inner core. One of the first outer core or the second outer core includes a fill portion that extends from the first opening to the second opening and thereby completely fills the at least one through hole.

BRIEF DESCRIPTION OF THE DRAWINGS

These and other aspects of the present invention as set forth in the appended claims may be more fully understood with reference to, but not limited by, following detailed description in connection with the accompanying drawings in which like numerals refer to like elements of the inventive golf ball and method of making same:

DETAILED DESCRIPTION

Figure 1:
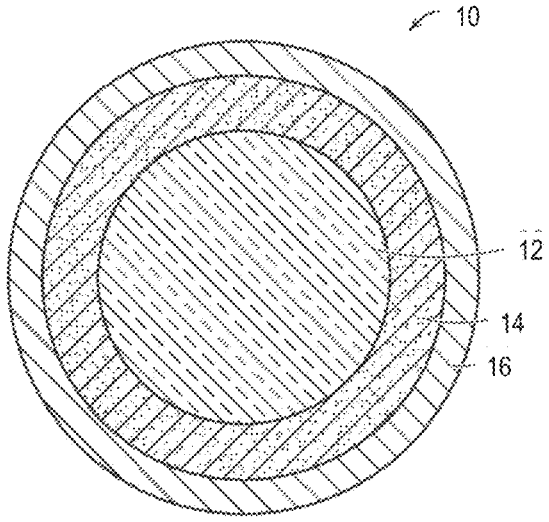
FIG. 1 is an example of a three-piece golf ball.

The present disclosure relates to multi-layer cores, golf balls having multi-layer cores, and methods of making golf balls and golf ball cores. Typically, the inner-most core of a dual- or multi-layer core golf ball is molded individually in a first step, and then subjected to a centerless grinding step in order to make the inner core more spherical. After this, additional core material is molded into a "shell," resulting in two partially-cured outer cores with half-sphere voids. The inner-most core is then loaded into the voids of the outer core shells before compression molding finishes curing the overall core.

During compression molding, the partially-cured outer core material moves and flows to take the shape of the outer mold. During this process, there is potential for shifting of the inner core relative to the center of the finished dual core. The present disclosure describes multi-layer core configurations including inner cores having at least one through hole for receiving a portion of the material of another core layer in order to inhibit shifting of the inner core and help ensure overall core symmetry and concentricity.

Core Formulations

The present disclosure describes golf balls having multi-layer cores. A multi-layer core may be, for example, a dual-core having an inner core layer and at least one outer core layer. The inner core layer may be made from a first composition and the outer core layer(s) may be made from a second, different composition. In an exemplary embodiment, each of the first and second compositions are made from a core rubber formulation. The compositions of the different layers may be considered different if they have different ingredients, different finished hardness, compression, resilience, or specific gravity, the materials have different Mooney viscosity, or other distinguishing characteristic. For example, a first composition may be a polybutadiene rubber having a relatively high hardness and a second composition may also be a polybutadiene rubber having a relatively low hardness, or vice versa. The different core rubber formulations may be selected based on golf ball performance, following conventional or unconventional concepts of multi-layer core technologies. The disclosed embodiments enhance the ability of multi-layer core manufacturing processes to produce consistent symmetry and concentricity by interlocking the different layers used in the multi-layer core.

Core rubber formulations include at least a base rubber and a hardening agent. In some embodiments, the core rubber formulations include a cross-linking agent, and a free radical initiator. Further, core rubber formulations may also optionally include additives, such as one or more of a metal oxide, metal fatty acid or fatty acid, antioxidant, soft and fast agent, or fillers. Concentrations of components are in parts per hundred (phr) unless otherwise indicated. As used herein, the term. "parts per hundred," also known as "phr" or "pph" is defined as the number of parts by weight of a particular component present in a mixture, relative to 100 parts by weight of the polymer component. Mathematically, this can be expressed as the weight of an ingredient divided by the total weight of the polymer, multiplied by a factor of 100.

Base Rubber

The core rubber formulations of the present disclosure include a base rubber. In some embodiments, the base rubber may include natural and synthetic rubbers and combinations of two or more thereof. Examples of natural and synthetic rubbers suitable for use as the base rubber include, but are not limited to, polybutadiene, polyisoprene, ethylene propylene rubber (EPR), ethylene-propylene-diene (EPDM) rubber, grafted EPDM rubber, styrene-butadiene rubber, styrenic block copolymer rubbers (such as "S", "SIS", "SB". "SBS", "SIBS", and the like, where "S" is styrene, "I" is isobutylene, and "B" is butadiene), polyalkenamers such as, for example, polyoctenamer, butyl rubber, halobutyl rubber, polystyrene elastomers, polyethylene elastomers, polyurethane elastomers, polyurea elastomers, metallocene-catalyzed elastomers and plastomers, copolymers of isobutylene and p-alkylstyrene, halogenated copolymers of isobutylene and p-alkylstyrene, copolymers of butadiene with acrylonitrile, polychloroprene, alkyl acrylate rubber, chlorinated isoprene rubber, acrylonitrile chlorinated isoprene rubber, and combinations of two or more thereof.

For example, the core may be formed from a rubber formulation that includes polybutadiene as the base rubber. Polybutadiene is a homopolymer of 1,3-butadiene. The double bonds in the 1,3-butadiene monomer are attacked by catalysts to grow the polymer chain and form a polybutadiene polymer having a desired molecular weight. Any suitable catalyst may be used to synthesize the polybutadiene rubber depending upon the desired properties. In one embodiment, a transition metal complex (for example, neodymium, nickel, or cobalt) or an alkyl metal such as alkyl lithium is used as a catalyst. Other catalysts include, but are not limited to, aluminum, boron, lithium, titanium, and combinations thereof. The catalysts produce polybutadiene rubbers having different chemical structures. In a cis-bond configuration, the main internal polymer chain of the polybutadiene appears on the same side of the carbon-carbon double bond contained in the polybutadiene. In a trans-bond configuration, the main internal polymer chain is on opposite sides of the internal carbon-carbon double bond in the polybutadiene. The polybutadiene rubber can have various combinations of cis- and trans-bond structures. For example, the polybutadiene rubber may have a 1,4 cis-bond content of at least 40 percent. In another embodiment, the polybutadiene rubber has a 1,4 cis-bond content of greater than 80 percent. In still another embodiment, the polybutadiene rubber has a 1,4 cis-bond content of greater than 90 percent. In general, polybutadiene rubbers having a high 1.4 cis-bond content have high tensile strength and rebound.

The polybutadiene rubber may have a relatively high or low Mooney viscosity. Generally, polybutadiene rubbers of higher molecular weight and higher Mooney viscosity have better resiliency than polybutadiene rubbers of lower molecular weight and lower Mooney viscosity. However, as the Mooney viscosity increases, the milling and processing of the polybutadiene rubber generally becomes more difficult. Blends of high and low Mooney viscosity polybutadiene rubbers may be prepared as is described in U.S. Pat. Nos. 6,982,301 and 6,774,187, the disclosures of which are hereby incorporated by reference, and used in accordance with the present disclosure. For example, the polybutadiene used in the rubber formulation may have a Mooney viscosity of about 30 to about 80 or about 40 to about 60. In an embodiment of the present disclosure, core rubber formulations used for one or more core layers may have a Mooney viscosity of about 30 to about 60. Polybutadiene rubbers within this range may adequately flow through channels in finished layers during molding to interlock core layers.

Examples of commercially available polybutadiene rubbers that can be used in rubber formulations in accordance with the present disclosure, include, but are not limited to, BR 01 and BR 1220, available from BST Elastomers of Bangkok, Thailand; SE BR 1220LA and SE BR 1203, available from DOW Chemical Co of Midland, Mich.; BUDENE 1207, 1207s, 1208, and 1280 available from Goodyear, Inc of Akron, Ohio; BR 01, 51 and 730, available from Japan Synthetic Rubber (JSR) of Tokyo, Japan; BUNA CB 21, CB 22, CB 23, CB 24, CB 25, CB 29 MES, CB 60, CB Nd 60, CB 55 NF, CB 70 B, CB KA 8967, and CB 1221, available from Lanxess Corp, of Pittsburgh. Pa.; BR1208, available from LG Chemical of Seoul, South Korea; UBEPOL BR130B, BR150, BR150B, BR 150L, BR230, BR360L, BR710, and VCR617, available from UBE Industries, Ltd, of Tokyo, Japan; EUROPRENE NEOCIS BR 60, INTENE 60 AF and P30AF, and EUROPRENE BR HV80, available from Polimeri Europa of Rome, Italy; KBR 01, NdBr 40, NdBR-45, NdBr 60, KBR 710S, KBR 710H, and KBR 750, available from Kumho Petrochemical Co., Ltd, Of Seoul, South Korea; DIENE 55NF, 70AC, and 320 AC, available from Firestone Polymers of Akron, Ohio; and PBR-Nd Group II and Group III, available from Nizhnekamskneftekhim, Inc, of Nizhnekamsk, Tartarstan Republic.

In another embodiment, the core is formed from a rubber formulation including butyl rubber. Butyl rubber is an elastomeric copolymer of isobutylene and isoprene. Butyl rubber is an amorphous, non-polar polymer with good oxidative and thermal stability, good permanent flexibility, and high moisture and gas resistance. Generally, butyl rubber includes copolymers of about 70 percent to about 99.5 percent by weight of an isoolefin, which has about 4 to 7 carbon atoms, for example, isobutylene, and about 0.5 percent to about 30 percent by weight of a conjugated multiolefin, which has about 4 to 14 carbon atoms, for example, isoprene. The resulting copolymer contains about 85 percent to about 99.8 percent by weight of combined isoolefin and about 0.2 percent to about 15 percent of combined multiolefin. A commercially available butyl rubber suitable for use in rubber formulations in accordance with the present disclosure includes Bayer Butyl 301 manufactured by Bayer AG.

The rubber formulations may include a combination of two or more of the above-described rubbers as the base rubber. In some embodiments, the rubber formulation of the present disclosure includes a blend of different polybutadiene rubbers. In this embodiment, the rubber formulation may include a blend of a first polybutadiene rubber and a second polybutadiene rubber in a ratio of about 5:95 to about 95:5. For example, the rubber formulation may include a first polybutadiene rubber and a second polybutadiene rubber in a ratio of about 10:90 to about 90:10 or about 15:85 to about 85:15 or about 20:80 to about 80:20 or about 30:70 to about 70:30 or about 40:60 to about 60:40. In other embodiments, the rubber formulation may include a blend of more than two polybutadiene rubbers or a blend of polybutadiene rubber(s) with any of the other elastomers discussed above.

In other embodiments, the rubber formulation used to form the core includes a blend of polybutadiene and butyl rubber. In this embodiment, the rubber formulation may include a blend of polybutadiene and butyl rubber in a ratio of about 10:90 to about 90:10. For example, the rubber formulation may include a blend of polybutadiene and butyl rubber in a ratio of about 10:90 to about 90:10 or about 20:80 to about 80:20 or about 30:70 to about 70:30 or about 40:60 to about 60:40. In other embodiments, the rubber formulation may include polybutadiene and/or butyl rubber in a blend with any of the other elastomers discussed above.

In further embodiments, the rubber formulation used to form the core includes a blend of polybutadiene and EPDM rubber or grafted EPDM rubber as the base rubber. In still further embodiments, the rubber formulations may include a combination of polybutadiene rubber and EPDM rubber as the base rubber. In this embodiment, the EPDM may be included in the rubber formulation in an amount of about 0.1 to about 20 or about 1 to about 15 or about 3 to about 10 parts by weight per 100 parts of the total rubber. For example, EPDM may be included in the rubber formulation in an amount of about 5 parts by weight per 100 parts of the total rubber. In still further embodiments, the core formulations may combine EPDM rubber and two or more different types of polybutadiene rubber, such as two or more different types of high cis-1,4 polybutadiene, as the base rubber.

The rubber formulations include the base rubber in an amount of 100 phr. That is, when more than one rubber component is used in the rubber formulation as the base rubber, the sum of the amounts of each rubber component should total 100 phr. In some embodiments, the rubber formulations include polybutadiene rubber as the base rubber in an amount of 100 phr. In other embodiments, the rubber formulations include polybutadiene rubber and a second rubber component. In this embodiment, the polybutadiene rubber may be used in an amount of about 80 to about 99.9 parts by weight per 100 parts of the total rubber and the second rubber component may be used in an amount of about 0.1 to about 20 parts by weight per 100 parts of the total rubber. In further embodiments, the polybutadiene rubber may be used in an amount of about 85 to about 99 parts by weight per 100 parts of the total rubber and the second rubber component may be used in an amount of about 1 to about 15 parts by weight per 100 parts of the total rubber. In yet other embodiments, the polybutadiene rubber may be used in an amount of about 90 to about 97 parts by weight per 100 parts of the total rubber and the second rubber component may be used in an amount of about 3 to about 10 parts by weight per 100 parts of the total rubber. In still further embodiments, the polybutadiene rubber may be used in an amount of about 94 to about 96 parts by weight per 100 parts of the total rubber and the second rubber component may be used in an amount of about 4 to about 6 parts by weight per 100 parts of the total rubber. In some embodiments, the second rubber component is EPDM rubber.

The base rubber may be used in the rubber formulation in an amount of at least about 5 percent by weight based on total weight of the rubber formulation. In some embodiments, the base rubber is included in the rubber formulation in an amount within a range having a lower limit of about 10 percent or 20 percent or 30 percent or 40 percent or 50 percent or 55 percent and an upper limit of about 60 percent or 70 percent or 80 percent or 90 percent or 95 percent or 100 percent. For example, the base rubber may be present in the rubber formulation in an amount of about 30 percent to about 80 percent by weight based on the total weight of the rubber formulation. In another example, the rubber formulation includes about 40 percent to about 70 percent base rubber based on the total weight of the rubber formulation.

Hardening Agent

The rubber formulations of the present disclosure may include a hardening agent. Without being bound to any particular theory, the hardening agent may affect the hardness of the core and the hardness gradient across the core. Suitable hardening agents include, but ae not limited to, benzoic compounds comprising a nitro functional group and one of a hydroxyl, amino, or sulfhydryl functional group. Nonlimiting examples of hardening agents include nitrophenol, nitroaniline, and nitrothiophenol. Different isomers of the hardening agent may be used such as, for example, 2-nitrophenol, 3-nitrophenol, 4-nitrophenol, 2-nitroaniline, 3-nitroaniline, 4-nitroaniline, 2-nitrothiophenol, 3-nitrothiophenol, 4-nitrothiophenol, and combinations thereof. Without being bound by any particular theory, different isomers of the hardening agent may affect the hardness of the core differently and produce different hardness gradients across the core. Some hardening agents, for example nitrophenol, may be advantageous because they are safe and/or easy to handle during manufacturing.

The hardening agent may be included in the rubber formulation in varying amounts depending on the desired characteristics of the golf ball core. For example, the hardening agent may be used in an amount of 0.01 to about 3 parts by weight per 100 parts of the total rubber. In one embodiment, the rubber formulation of the core includes about 0.05 to about 1.5 or about 0.1 to about 1 or about 0.1 to 0.5 parts by weight hardening agent per 100 parts of the total rubber. In another embodiment, the hardening agent is included in the rubber formulation in an amount of about 0.2 to about 0.7 parts by weight per 100 parts of the total rubber. In still another embodiment, the rubber formulation includes about 0.05 to about 0.3 or 0.2 to about 0.4 or about 0.3 to about 0.5 or about 0.4 to about 0.6 parts by weight hardening agent per 100 parts of the total rubber.

In some respects, the amount of hardening agent in the rubber formulation required to produce the desired hardness gradient may differ based on the compound, and even the particular isomer of the compound, used as the hardening agent. For example, when the rubber formulation includes 2-nitrophenol, which has a nitro functional group ortho to a hydroxyl functional group, the hardening agent may be used in an amount of about 0.1 to about 0.3 parts by weight per 100 parts of the total rubber to achieve the desired hardness gradient. In other embodiments, when the rubber formulation includes 3-nitrophenol, which has a nitro functional group meta to a hydroxyl functional group, the hardening agent may be used in an amount of about 0.2 to about 0.4 parts by weight per 100 parts of the total rubber to achieve the desired hardness gradient. In further embodiments, when the rubber formulation includes 4-nitrophenol, which has a nitro functional group para to a hydroxyl functional group, the hardening agent may be used in an amount of about 0.3 to about 0.5 parts by weight hardening agent per 100 parts of the total rubber to achieve the desired hardness gradient. Without being bound by any particular theory, the relative positions of the functional groups on disubstituted benzoic hardening agents are believed to influence the effectiveness of the compound as a hardening agent. Accordingly, the amount of hardening agent needed to produce a desired hardness gradient may change when different isomers within a class of compounds are used.

Crosslinking Co-Agent

The rubber formulations further may include a reactive cross-linking co-agent. Suitable co-agents include, but are not limited to, metal salts of unsaturated carboxylic acids having from 3 to 8 carbon atoms; unsaturated vinyl compounds and polyfunctional monomers (e.g., trimethylolpropane trimethacrylate); phenylene bismaleimide; and combinations thereof. In one embodiment, the co-agent is one or more metal salts of acrylates, diacrylates, methacrylates, and dimethacrylates, wherein the metal is selected from magnesium, calcium, zinc, aluminum, lithium, and nickel. In another embodiment, the co-agent includes one or more zinc salts of acrylates, diacrylates, methacrylates, and dimethacrylates. For example, the co-agent may be zinc diacrylate (ZDA). In another embodiment, the co-agent may be zinc dimethacrylate (ZDMA). An example of a commercially available zinc diacrylate includes Dymalink® 526 manufactured by Cray Valley.

The co-agent may be included in the rubber formulation in varying amounts depending on the desired characteristics of the golf ball core. For example, the co-agent may be used in an amount of about 5 to about 50 or about 10 to about 45 or about 15 to about 40 parts by weight per 100 parts of the total rubber. In one embodiment, the rubber formulation of the core includes about 35 to about 48 parts by weight co-agent per 100 parts of the total rubber. In another embodiment, the rubber formulation includes about 38 to about 45 or about 39 to about 42 parts by weight co-agent per 100 parts of total rubber. In another embodiment, the co-agent is included in the rubber formulation of the core in an amount of about 29 to about 37 or about 31 to about 35 parts by weight per 100 parts of the total rubber. In still another embodiment, the rubber formulation includes about 25 to about 33 or about 27 to about 31 parts by weight co-agent per 100 parts of the total rubber.

In some respects, the amount of co-agent in the rubber formulation may be altered based on the class of compounds, and the particular isomer within a class of compounds, used as the hardening agent. For example, when the rubber formulation includes 2-nitrophenol, the co-agent may be included in the rubber formulation in amount from about 37 to about 43 or about 39 to about 41 parts by weight per 100 parts of the total rubber. In another example, when the rubber formulation includes 3-nitrophenol, the co-agent may be included in the rubber formulation in amount from about 30 to about 36 or about 32 to about 34 parts by weight per 100 parts of the total rubber. In yet another example, when the rubber formulation includes 4-nitrophenol, the co-agent may be included in the rubber formulation in amount from about 26 to about 32 or about 28 to about 30 parts by weight per 100 parts of the total rubber. Without being bound to any particular theory, the concentration of co-agent may be altered to achieve the desired compression of the golf ball core when different hardening agents are used.

Free Radical Initiator

The core formulations may include a free radical initiator selected from an organic peroxide, a high energy radiation source capable of generating free radicals, or a combination thereof. Suitable organic peroxides include, but are not limited to, dicumyl peroxide; n-butyl-4,4-di(t-butylperoxy) valerate; 1,1-di(t-butylperoxy)3,3,5-trimethylcyclohexane; 2,5-dimethyl-2,5-di(t-butylperoxy) hexane; di-t-butyl peroxide; di-t-amyl peroxide; t-butyl peroxide; t-butyl cumyl peroxide; 2,5-dimethyl-2,5-di(t-butylperoxy)hexyne-3; di(2-t-butyl-peroxyisopropyl)benzene; dilauroyl peroxide; dibenzoyl peroxide; t-butyl hydroperoxide; and combinations thereof. In a particular embodiment, the free radical initiator is dicumyl peroxide, including, but not limited to Perkadox® BD-FF, commercially available from Akzo Nobel. In other embodiments, the free radical initiator is dimethyl terbutyl peroxide, including, but not limited to Trigonox® 101-50D-PD, commercially available from Nouryon.

Free radical initiators may be present in the rubber formulation in an amount of at least 0.05 parts by weight per 100 parts of the total rubber, or an amount within the range having a lower limit of 0.05 parts or 0.1 parts or 1 part or 1.25 parts or 1.5 parts or 2.5 parts or 5 parts by weight per 100 parts of the total rubber, and an upper limit of 2.5 parts or 3 parts or 5 parts or 6 parts or 10 parts or 15 parts by weight per 100 parts of the total rubber. For example, the rubber formulation may include peroxide free radical initiators in an amount of about 0.1 to about 10 or about 0.5 to about 6 or about 1 to about 5 parts by weight per 100 parts of the total rubber. In another example, the rubber formulation may include peroxide free radical initiators in an amount of about 0.5 to about 2 or about 0.7 to about 1.8 or about 0.8 to about 1.2 or about 1.3 to about 1.7 parts by weight per 100 parts of the total rubber. In yet another example, the rubber formulation may include peroxide free radical initiators in an amount of about 1.5 to about 3 or about 1.7 to about 2.8 or about 1.8 to about 2.2 or about 2.3 to about 2.7 parts by weight per 100 parts of the total rubber.

Additives

Radical scavengers such as a halogenated organosulfur, organic disulfide, or inorganic disulfide compounds may also be added to the rubber formulation. In one embodiment, a halogenated organosulfur compound included in the rubber formulation includes, but is not limited to, pentachlorothiophenol (PCTP) and salts of PCTP such as zinc pentachlorothiophenol (ZnPCTP). In another embodiment, ditolyl disulfide, diphenyl disulfide, dixylyl disulfide, 2-nitroresorcinol, and combinations thereof are added to the rubber formulation. An example of a commercially available radical scavenger includes Rhenogran® Zn-PTCP-72 manufactured by Rheine Chemie. The radical scavenger may be included in the rubber formulation in an amount of about 0.3 to about 1 part by weight per 100 parts of the total rubber. In one embodiment, the rubber formulation may include about 0.4 to about 0.9 parts by weight radical scavenger per 100 parts of the total rubber. In another embodiment, the rubber formulation may include about 0.5 to about 0.8 parts by weight radical scavenger per 100 parts of the total rubber.

The rubber formulation may also include filler(s). Suitable non-limiting examples of fillers include carbon black, clay and nanoclay particles, talc, glass (e.g., glass flake, milled glass, and microglass), mica and mica-based pigments (e.g., Iriodin® pearl luster pigments from The Merck Group), and combinations thereof. Metal oxide and metal sulfate fillers are also contemplated for inclusion in the rubber formulation. Suitable metal fillers include, for example, particulate, powders, flakes, and fibers of copper, steel, brass, tungsten, titanium, aluminum, magnesium, molybdenum, cobalt, nickel, iron, lead, tin, zinc, barium, bismuth, bronze, silver, gold, and platinum, and alloys and combinations thereof. Suitable metal oxide fillers include, for example, zinc oxide, iron oxide, aluminum oxide, titanium oxide, magnesium oxide, and zirconium oxide. Suitable metal sulfate fillers include, for example, barium sulfate and strontium sulfate. When included, the fillers may be in an amount of about 1 to about 25 parts by weight per 100 parts of the total rubber. In one embodiment, the rubber formulation includes at least one filler in an amount of about 5 to about 20 or about 8 to about 15 parts by weight per 100 parts of the total rubber. In another embodiment, the rubber formulation includes at least one filler in an amount of about 8 to about 14 or about 10 to about 12 parts by weight per 100 parts of the total rubber. In yet another embodiment, the rubber formulation includes at least one filler in an amount of about 10 to about 17 or about 12 to about 15 parts by weight per 100 parts of the total rubber. In yet another embodiment, the rubber formulation includes at least one filler in an amount of about 10 to about 16 or about 12 to about 15 parts by weight per 100 parts of the total rubber. In a further embodiment, the rubber formulation includes at least one filler in an amount of about 12 to about 18 or about 14 to about 16 parts by weight per 100 parts of the total rubber. An example of a commercially available barium sulfate filler includes PolyWate® 325 manufactured by Cimbar Performance Minerals.

In some aspects, the amount of filler in the rubber formulation may be altered based on the compound, and the particular isomer of the compound, used as the hardening agent. For example, when the rubber formulation includes 2-nitrophenol, at least one filler may be included in the rubber formulation in amount from about 9 to about 13 parts by weight per 100 parts of the total rubber. In another example, when the rubber formulation includes 3-nitrophenol, the filler may be included in the rubber formulation in amount from about 11 to about 16 parts by weight per 100 parts of the total rubber. In yet another example, when the rubber formulation includes 4-nitrophenol, the filler may be included in the rubber formulation in amount from about 13 to about 17 parts by weight per 100 parts of the total rubber.

In some embodiments, more than one type of filler may be included in the rubber formulation. For example, the rubber formulation may include a first filler in an amount from about 5 to about 20 or about 8 to about 17 parts by weight per 100 parts total rubber and a second filler in an amount from about 1 to about 10 or about 3 to about 7 parts by weight per 100 parts total rubber. In another example, the rubber formulation may include a first filler in an amount from about 7 to about 13 or about 9 to about 12 parts by weight per 100 parts total rubber and a second filler in an amount from about 2 to about 8 or about 4 to about 6 parts by weight per 100 parts total rubber. In yet another example, the rubber formulation may include a first filler in an amount from about 10 to about 15 or about 13 to about 14 parts by weight per 100 parts total rubber and a second filler in an amount from about 2 to about 9 or about 3 to about 7 parts by weight per 100 parts total rubber. In a further example, the rubber formulation may include a first filler in an amount from about 10 to about 15 or about 13 to about 14 parts by weight per 100 parts total rubber and a second filler in an amount from about 13 to about 18 or about 14 to about 16 parts by weight per 100 parts total rubber.

Antioxidants, processing aids, accelerators (for example, tetra methylthiuram), dyes and pigments, wetting agents, surfactants, plasticizers, coloring agents, fluorescent agents, chemical blowing and foaming agents, defoaming agents, stabilizers, softening agents, impact modifiers, antiozonants, as well as other additives known in the art, may also be added to the rubber formulation. Examples of suitable processing aids include, but are not limited to, high molecular weight organic acids and salts thereof. Suitable organic acids are aliphatic organic acids, aromatic organic acids, saturated mono-functional organic acids, unsaturated mono-functional organic acids, multi-unsaturated mono-functional organic acids, and dimerized derivatives thereof. In one embodiment, the organic acids include, but are not limited to, caproic acid, caprylic acid, capric acid, lauric acid, stearic acid, behenic acid, erucic acid, oleic acid, linoleic acid, myristic acid, benzoic acid, palmitic acid, phenylacetic acid, naphthalenoic acid, and dimerized derivatives thereof. The salts of organic acids include the salts of barium, lithium, sodium, zinc, bismuth, chromium, cobalt, copper, potassium, strontium, titanium, tungsten, magnesium, cesium, iron, nickel, silver, aluminum, tin, or calcium, salts of fatty acids, particularly stearic, behenic, erucic, oleic, linoelic or dimerized derivatives thereof.

Curing a Core Formulation

The base rubber, hardening agent, cross-linking agent, free radical initiator, fillers, and any other materials used in forming the core, in accordance with the present disclosure, may be combined to form a mixture by any type of mixing known to one of ordinary skill in the art. Suitable types of mixing include single pass and multi-pass mixing, and the like. A single pass mixing process where ingredients are added sequentially may be used, as this type of mixing tends to increase efficiency and reduce costs for the process. In embodiments where a free-radical initiator is used, it may be desirable to combine the hardening agent into the rubber formulation prior to adding the free-radical initiator.

The rubber formulation may be cured using conventional curing processes. Non-limiting examples of curing processes suitable for use in accordance with the present disclosure include peroxide-curing, sulfur-curing, high-energy radiation, and combinations thereof.

Golf Ball Construction

Golf balls having various constructions may be made in accordance with the present disclosure. Golf balls consistent with the present disclosure include at least one cover layer and at least two core layers. For example, the present disclosure may include golf balls having three-piece, four-piece, and five or more-piece constructions, with the term "piece" referring to any core, cover, or intermediate layer of a golf ball construction.

Figure 2:
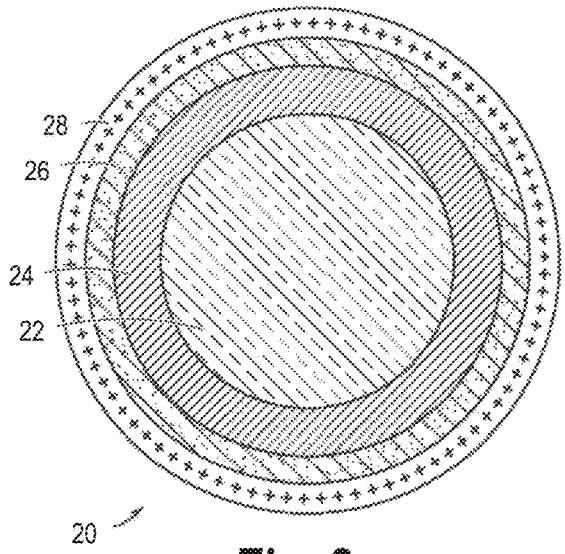
FIG. 2 is an example of a four-piece golf ball.
Figure 3:
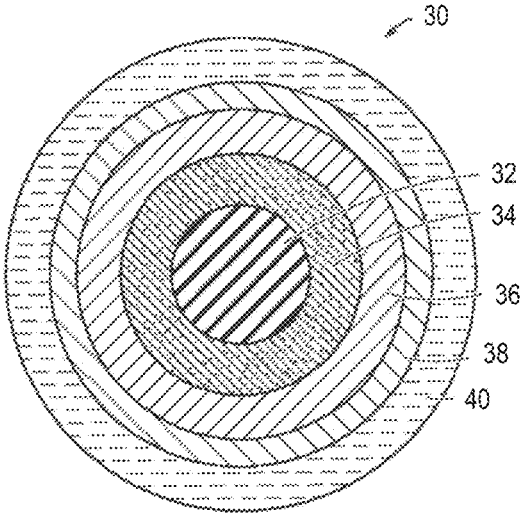
FIG. 3 is an example of a five-piece golf ball.

FIGS. 1-3 include examples of multi-piece golf balls. The golf balls shown in FIGS. 1-3 are exemplary to illustrate different numbers of pieces or layers that may be in a golf ball and do not necessarily illustrate cores having interlocking layers as will be described in more detail below. One of ordinary skill in the art would understand that the core layers shown in FIGS. 1-3 may intersect FIG. 1 shows a three-piece golf ball 10 including a first core layer 12, a second core layer 14, and a cover layer 16. Referring to FIG. 2, in another embodiment, a four-piece golf ball 20 includes an first core layer 22, a second core layer 24, an intermediate layer 26, and a cover layer 28. In FIG. 2, the intermediate layer 26 may be considered a casing or mantle layer, an inner cover layer, a third core layer, or any other layer disposed between the second core layer 24 and the cover layer 28. Referring to FIG. 3, in another embodiment, a five-piece golf ball 30 comprises a three-layered core having a first core layer 32, an second core layer 34, and a third core layer 36. The golf ball 30 also includes an intermediate layer 38, and a cover layer 40. The intermediate layer 38 may be considered a casing or mantle layer, an inner cover layer, a fourth core layer, or any other layer disposed between the third core layer 36 and the cover layer 40. As exemplified herein, a golf ball in accordance with the present disclosure can comprise any combination of two or more core layers, zero or more intermediate layers, and one or more cover layers.

The rubber formulations discussed above are suitable for use in one or more of the core layers. It is also contemplated that the rubber formulations disclosed herein may be used to form one or more of the layers of any of the three, four, or five, or more-piece (layered) balls mentioned above. That is, any of the core layers, intermediate layers, and/or cover layers may comprise the rubber formulation of this disclosure. The rubber formulations of different layers may be the same or different. The diameter and thickness of the different layers along with properties such as hardness and compression may vary depending upon the construction and desired playing performance properties of the golf ball.

Golf balls made in accordance with the present disclosure can be of any size, although the USGA requires that golf balls used in competition have a diameter of at least 1.68 inches. For play outside of United States Golf Association (USGA) rules, the golf balls can be of a smaller size. In one embodiment, golf balls made in accordance with the present disclosure have a diameter in the range of about 1.68 to about 1.80 inches.

Different materials may be used in the construction of the intermediate and cover layers of golf balls according to the present disclosure. For example, a variety of materials may be used for forming the outer cover including, for example, polyurethanes; polyureas; copolymers, blends and hybrids of polyurethane and polyurea; olefin-based copolymer ionomer resins; polyethylene, including, for example, low density polyethylene, linear low density polyethylene, and high density polyethylene; polypropylene; rubber-toughened olefin polymers; acid copolymers, for example, poly(meth) acrylic acid, which do not become part of an ionomeric copolymer, plastomers; flexomers; styrene/butadiene/styrene block copolymers; styrene/ethylene-butylene/styrene block copolymers; dynamically vulcanized elastomers; copolymers of ethylene and vinyl acetates; copolymers of ethylene and methyl acrylates; polyvinyl chloride resins; polyamides, poly(amide-ester) elastomers, and graft copolymers of ionomer; cross-linked trans-polyisoprene and blends thereof; polyester-based thermoplastic elastomers; polyurethane-based thermoplastic elastomers; synthetic or natural vulcanized rubber; and combinations thereof.

In one embodiment, the cover is formed from a polyurethane, polyurea, or hybrid of polyurethane-polyurea. When used as cover layer materials, polyurethanes and polyureas can be thermoset or thermoplastic. Thermoset materials can be formed into golf ball layers by conventional casting or reaction injection molding techniques. Thermoplastic materials can be formed into golf ball layers by conventional compression or injection molding techniques.

Conventional and non-conventional materials may be used for forming intermediate layers of the ball including, for instance, ionomer resins, highly neutralized polymers, polybutadiene, butyl rubber, and other rubber-based core formulations, and the like. In one embodiment, the inner cover layer, i.e., the layer disposed between the core and the outer cover, includes an ionomer. In this aspect, ionomers suitable for use in accordance with the present disclosure may include partially neutralized ionomers and highly neutralized ionomers (HNPs), including ionomers formed from blends of two or more partially-neutralized ionomers, blends of two or more highly-neutralized ionomers, and blends of one or more partially-neutralized ionomers with one or more highly-neutralized ionomers. For purposes of the present disclosure, "HNP" refers to an acid copolymer after at least 70 percent of all acid groups present in the composition are neutralized.

The compositions used to make the layers outside of the core, e.g., the outer cover layer and, when present, the inner cover layer, may contain a variety of fillers and additives to impart specific properties to the ball. For example, relatively heavy-weight and light-weight metal fillers such as, particulate; powders; flakes; and fibers of copper, steel, brass, tungsten, titanium, aluminum, magnesium, molybdenum, cobalt, nickel, iron, lead, tin, zinc, barium, bismuth, bronze, silver, gold, and platinum, and alloys and combinations thereof may be used to adjust the specific gravity of the ball. Other additives and fillers include, but are not limited to, optical brighteners, coloring agents, fluorescent agents, whitening agents, UV absorbers, light stabilizers, surfactants, processing aids, antioxidants, stabilizers, softening agents, fragrance components, plasticizers, impact modifiers, titanium dioxide, clay, mica, talc, glass flakes, milled glass, and mixtures thereof.

The golf balls of the present disclosure may be formed using a variety of application techniques. For example, the golf ball, golf ball core, or any layer of the golf ball may be formed using compression molding, flip molding, injection molding, retractable pin injection molding, reaction injection molding (RIM), liquid injection molding (LIM), casting, vacuum forming, powder coating, flow coating, spin coating, dipping, spraying, and the like. Conventionally, compression molding and injection molding are applied to thermoplastic materials, whereas RIM, liquid injection molding, and casting are employed on thermoset materials. In this aspect, cover layers may be formed over the core using any suitable technique that is associated with the material used to form the layer. Preferably, each cover layer is separately formed over the core. For example, an ethylene acid copolymer ionomer composition may be injection-molded to produce half-shells over the core. Alternatively, the ionomer composition can be placed into a compression mold and molded under sufficient pressure, temperature, and time to produce the hemispherical shells, which may then be placed around the core in a compression mold. An outer cover layer including a polyurethane or polyurea composition over the ball sub-assembly may be formed by using a casting process.

Golf balls made in accordance with the present disclosure may be subjected to finishing steps such as flash-trimming, surface-treatment, marking, coating, and the like using techniques known in the art. In one embodiment, a white-pigmented cover may be surface-treated using a suitable method such as, for example, corona, plasma, or ultraviolet (UV) light-treatment. Indicia such as trademarks, symbols, logos, letters, and the like may be printed on the cover using pad-printing, ink-jet printing, dye-sublimation, or other suitable printing methods. Clear surface coatings (for example, primer and topcoats), which may contain a fluorescent whitening agent, may be applied to the cover. Golf balls may also be painted with one or more paint coatings in a variety of colors. In one embodiment, white primer paint is applied first to the surface of the ball and then a white top-coat of paint may be applied over the primer.

Examples of Interlocking Cores

Golf balls consistent with the present disclosure include at least a core and a cover. Some golf balls may include an intermediate layer, such as a casing layer, between the core and the cover. According to embodiments of the present disclosure, the core includes at least two core layers and at least two layers of the core are formed to interlock with each other. Each of the core layers may be made from a core rubber formulation.

According to at least some embodiments, the layers of the core are integrally formed to create a singular component used in the manufacturing of golf balls. In other words, disclosed cores can be molded to be one element and held together as a single sphere that is later placed in a mold to be surrounded by cover material. A person could pick up and hold a core with interlocking layers according to the present disclosure. The term core, as used herein, refers to the combined layers of rubber formulations that are configured to be used in finished golf balls.

In an exemplary embodiment, the core layers are formed into a singular core using compression molding. In one example, a spherical first core layer is surrounded by shells of a second core layer and placed under pressure to mold the second core layer into the shape of a sphere surrounding the first core layer. Each core layer may be considered a core component of the singular, combined core. According to disclosed embodiments, at least one of the core components is formed as a sphere to serve as a base or inner core component. The inner core component has at least one through hole extending therethrough. Additional core components may include core layers that are molded around the inner core component to create a multi-layered sphere as a singular, combined component. At least one of the core layers molded around the inner core include a portion thereof that extends into a through hole in the inner core component. The portion of the outer core component that extends into the through hole may connect all the way through to form a bridge connecting opposing areas of the outer core component.

Figure 4:
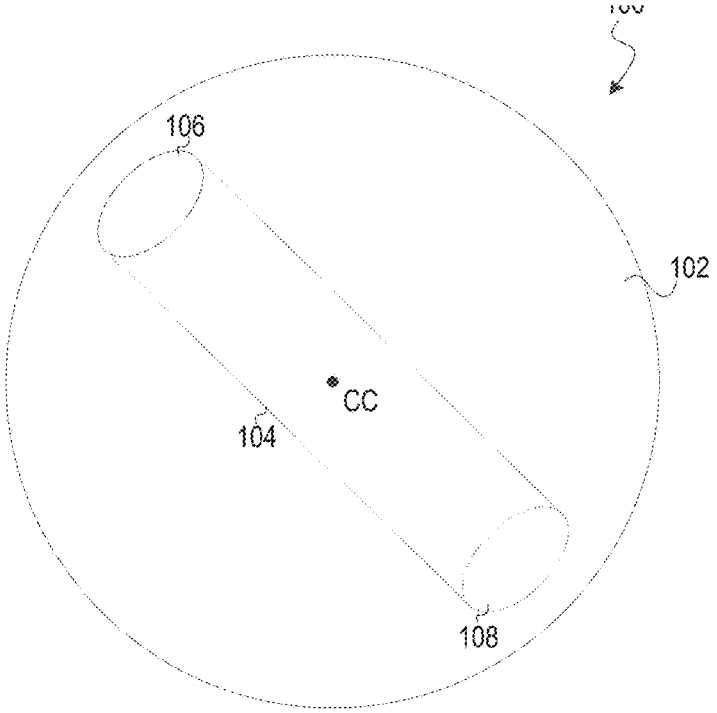
FIG. 4 is a perspective view of an inner core having a through hole.
Figure 5:
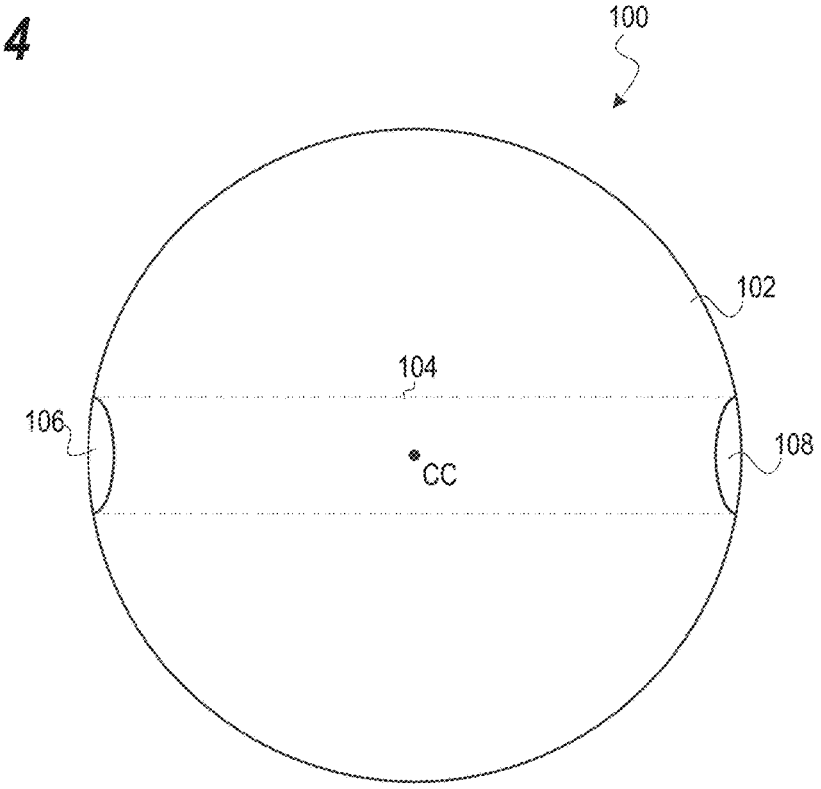
FIG. 5 is a side view of the inner core of FIG. 4.

FIGS. 4 and 5 depict an exemplary core component for use in making a core for a golf ball, consistent with disclosed embodiments. The core component shown in FIG. 4 is an inner core 100. The term "inner core" as used herein refers to an inner-most core layer of a multi-layer core. In this way, the inner core 100 is made to be enclosed by at least one outer core, as will be described in more detail. The term "outer core" as used herein refers to a core layer that is not the inner core. As a result, for the purpose of this disclosure, a multi-layer core can have one inner core and multiple outer cores.

The inner core 100 is generally spherical and has a spherical surface 102. The inner core 100 defines a core center point CC that is the geometric center of the sphere or an approximation thereof. The inner core 100 is formed from a first core composition, which may be a core rubber formulation described herein or another core composition known in the art. The inner core 100 has a through hole 104 that extends from a first opening 106 in the spherical surface 102 to a second opening 108 in the spherical surface 102. The through hole 104 forms a hollow channel in the body of the inner core 100. The through hole 104 passes through the core center point CC. In some embodiments, a line that runs through a center of the through hole 104 (and parallel to the direction of the through hole 104) also passes through the core center point CC.

There are various methods that can be followed to create the through hole 104 in the inner core 100. In one example, a solid inner core is formed in a conventional process, such as through molding and centerless grinding to form a sphere. Thereafter, one or more through holes are drilled or otherwise bored through the sphere. In another example, an inner core may be initially formed with one or more integral through holes. For instance, the inner core may be molded in a form having a pin around which the core material sets, with the pin being removed after molding. In another example, the inner core may be 3D-printed with at least one through hole. Other inner cores described in this disclosure may include one or more through holes made in this manner. For example, another inner core may include two drilled through holes.

According to disclosed embodiments, a through hole in an inner core of the present disclosure may be generally cylindrical with a constant diameter along its entire length. In some embodiments, the diameter of the cylinder may be in a range from 0.05 in, to 0.38 in. The length of the through hole may be equal to a diameter of the inner core. In other instances, the length of the through hole may be less than the diameter of the inner core (i.e., if the through hole does not pass through the core center point.

In alternative embodiments, the through hole 104 may have other shapes other that cylindrical. For instance, the through hole may be square or rectangular. The openings in the spherical surface that lead into the through hole may have shape that matches the shape of the through hole. For instance, a square or rectangular through hole may have square or rectangular openings. The inner cores disclosed herein may have any size; including diameters of 1.01", 1.130", 1.390", etc.

FIG. 4 is a perspective view of the inner core 100 showing the through hole 104 and the second opening 108 in phantom lines. FIG. 5 is a side view of the inner core 100, showing the through hole 104 and its path through the core center point CC. Moreover. FIG. 5 illustrates that the through hole 104 may be a channel extending from one pole of the inner core 100 to an opposite pole of the inner core 100. The embodiment of the inner core 100 in FIGS. 4 and 5 includes one through hole 104. It should be understood that inner cores consistent with this disclosure include at least one through hole. That is, some embodiments may include more than one through hole formed in the inner core.

For example, an embodiment may have two through holes. Other embodiments include inner cores having 3, 4, 5, 6, or 7 through holes. While 8 or more through holes are possible, the inclusion of too many though holes may affect the integrity and/or durability of the inner core.

Further, in order to maintain the integrity of the inner core, the maximum diameter of a through hole (or effective diameter if the through hole is not cylindrical) may depend on the number of through holes in the inner core. In other words, all through holes formed in an inner core consistent a disclosed embodiment have diameters that at least exceed the minimum diameter, but do not exceed the given maximum diameter for the total number of through holes present in the inner core. In one example, a given through hole in an inner core (having seven or less total through holes) has a minimum diameter of 0.05 in, and a maximum diameter according to the following equation, where x is the total number of through holes in the inner core:

$$\text{Max Diameter(in.)} = 1.35 - \frac{23 + x}{25}$$

It should be understood that the size/shape of the though hole may change after an outer core layer is molded onto the inner core. For example, the through hole may experience radial expansion at one or more locations along the length of the through hole. This may give the through hole a bowed-out appearance in a cross section. As a result, in at least some embodiments, the minimum/maximum diameters of the through holes apply before an outer core is molded onto the inner core and material enters the through holes.

Figure 6:
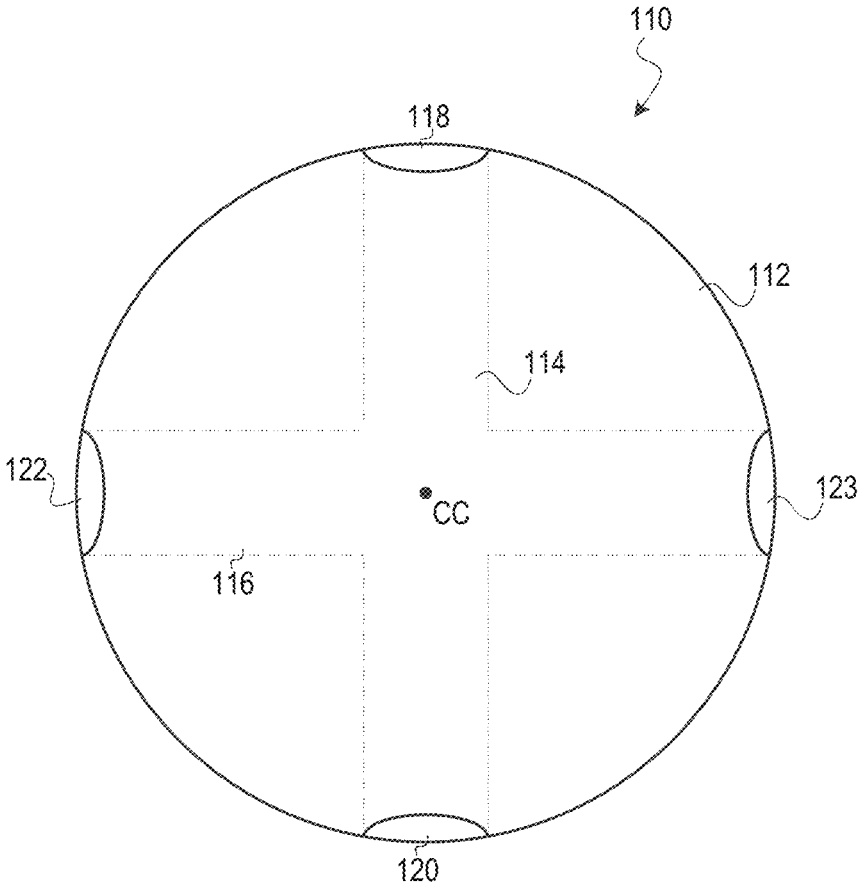
FIG. 6 is a side view of an inner core having two through holes.

FIG. 6 is side view of an inner core 110 according to another embodiment. The inner core 110 includes a generally spherical shape defining a spherical surface 112 and two through holes 114, 116. In particular, the inner core 110 includes a first through hole 114 extending from a first opening 118 in the spherical surface 112 to a second opening 120 in the spherical surface 112, and a second through hole 116 extending from a first opening 122 in the spherical surface to a second opening 123 in the spherical surface 112. The through holes 114, 116 are arranged perpendicular to each other as shown in FIG. 2. For example, the two through holes 114, 116 may be linear channels that are aligned with axes that are perpendicular to each other. Other embodiments having two through holes may have other relative arrangements. Both through holes 114, 116 pass through the core center point CC of the inner core 110.

Figure 7:
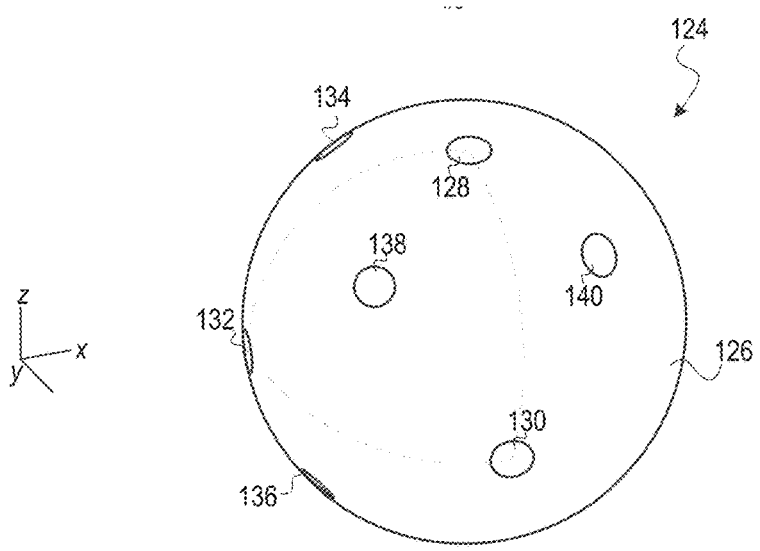
FIG. 7 is a perspective view of an inner core having seven through holes.
Figure 8:
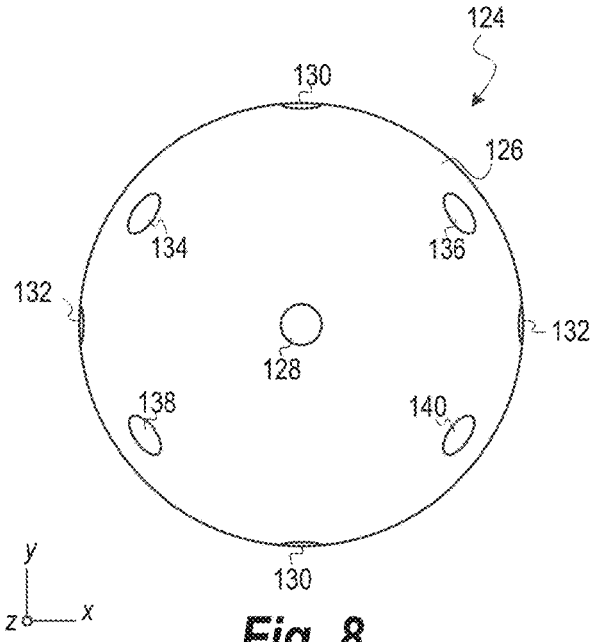
FIG. 8 is a top view of the inner core of FIG. 7.
Figure 9:
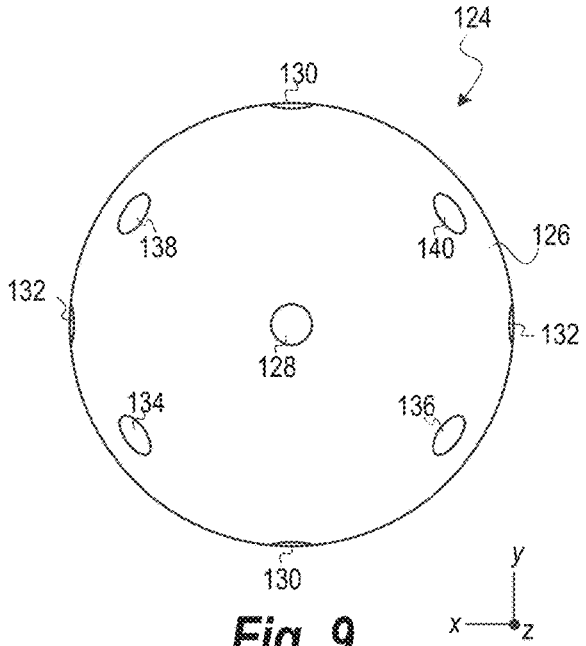
FIG. 9 is a bottom view of the inner core of FIG. 7.

FIG. 7 is a perspective view of an inner core 124 having a spherical surface 126. The inner core 124 includes seven through holes, each with two openings formed in the spherical surface 126. FIGS. 8 and 9 are opposing top and bottom views of the inner core 124. In an exemplary embodiment, the through holes are oriented isometrically, such that adjacent openings on the surface of the inner core are equidistant from one another. In FIG. 7, the through holes are labeled as 128, 130, 132, 134, 136, 138, and 140. Through holes 128, 130, and 132 include openings that are aligned with x, y, and z axes such that the three of the through holes 128, 130, 132 are perpendicular to each other. For example, these through holes 128, 130, 132 may be aligned with axes and extend linearly from a first pole on the spherical surface 126 to an opposite pole on the spherical surface 126. Through holes 134, 136, 138 and 140 are placed symmetrically between and equidistant to the through holes 128, 130, and 132. For example, three adjacent openings into through holes 128, 130, and 132 may form an octahedral segment (shown as a triangular area in FIG. 7) with an opening into one of through holes 134, 136, 138, 140 at a center thereof. All of the through holes 128, 130, 132, 134, 136, 138, and 140 may intersect a core center point of the inner core 124.

The inner cores 100, 110, 124 are examples of core components having through holes. These core components may be made from a first composition, such as a first core rubber formulation. According to disclosed embodiments, at least one outer core component is layered onto the inner core, such as the inner cores 100, 110, 124. The outer core component may be a second composition, which may be a second core rubber formulation, different from the first core rubber formulation. According to disclosed embodiments, the second composition of at least one of the outer cores may enter the through hole(s) during a molding operation. In this way, the through holes are completely filled with a composition different than the composition that makes up the inner core having the through holes therein.

FIGS. 10-13 show cross-sections of cores having an inner core with at least one through hole and at least one outer core layered onto the inner core, with outer core composition within the at least one through hole.

Figure 10:
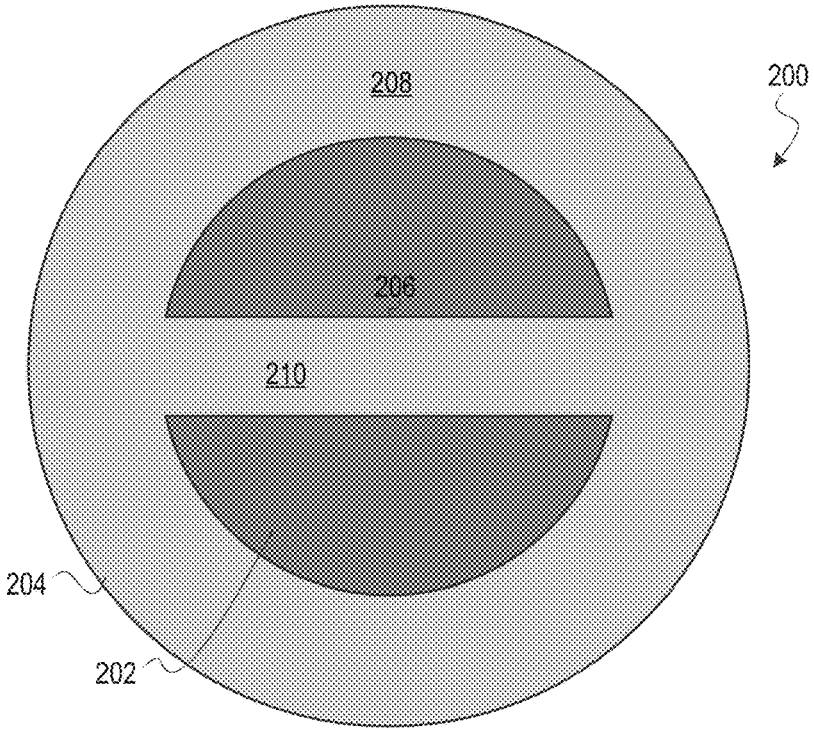
FIG. 10 is a cross-sectional view of a two-layer core, according to a first embodiment.

FIG. 10 is a depiction of a core 200 having an inner core 202 and an outer core 204. The inner core 202 is generally spherical and includes a spherical outer surface. The inner core 202 includes a through hole 206 that extends between openings in the spherical outer surface. The inner core 202 may correspond to the inner core 100 of FIGS. 4 and 5. The outer core 204 includes a surrounding portion 208 and a fill portion 210. The surrounding portion 208 is located exterior to the inner core 202 and includes a thickness measured from an outer surface of the inner core 202 to an outer surface of the outer core 204. The surrounding portion 208 of the outer core 204 is a generally spherical layer of the overall core 200 with an outer surface that maintains the core 200 as a generally spherical body to be used in a golf ball. The fill portion 210 is positioned within the through hole 206 of the inner core 202. The outer core 204 thus extends from a first opening of the through hole 206 to a second opening of the through hole 206. In this way, the outer core 204 is interlocked with the inner core 202 to form the multi-layer core 200. The outer core 204 is preferably made from a different composition than the inner core 202.

Figure 11:
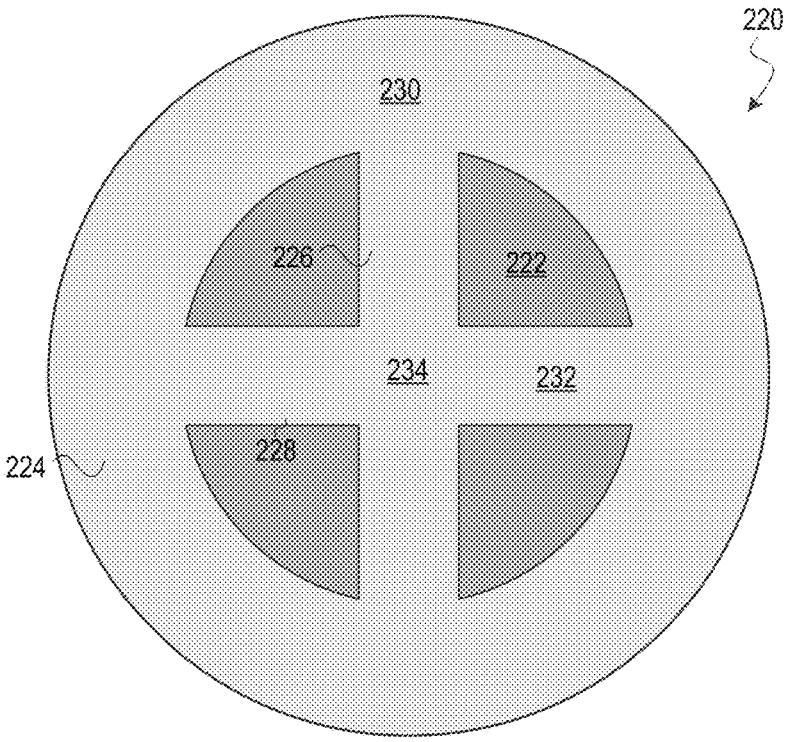
FIG. 11 is a cross-sectional view of a two-layer core, according to a second embodiment.

FIG. 11 is a depiction of a core 220 having an inner core 222 and an outer core 224. The inner core 222 includes two through holes 226, 228. The inner core 222 may correspond to the inner core 110 of FIG. 6. The two through holes 226, 228 are perpendicular to each other and intersect at a center of the core 220. The outer core 224 includes a surrounding portion 230 and a fill portion 232. The surrounding portion 230 is located exterior to the inner core 222 and includes a thickness measured from an outer surface of the inner core 222 to an outer surface of the outer core 224. The fill portion 232 is positioned within the through holes 226, 228 of the inner core 222. The fill portion 232 may include a core center junction 234 that connects all of the outer core material that fill the more than one through holes 226, 228. Other cores having inner cores with two or more through holes may have a similar core center junction.

In order to make the cores 200, 220, a compression molding and curing process may be used that allows the composition of the outer core to flow into the through holes formed in the inner cores. The material flow into the through holes may occur mostly during a curing cycle portion of the molding process. During curing, the composition may have a sufficient temperature and material property to enable the material to flow through the openings in the outer spherical surface of the inner core and "meet" at a center portion. In making the core 220 having multiple through holes 226, 228 in the inner core 222, the composition of the outer core 224 may flow into the four openings of the two through holes and meet at the core center point to produce the core center junction 234. In this way, the composition of the outer core is located at the core center point.

Figure 12:
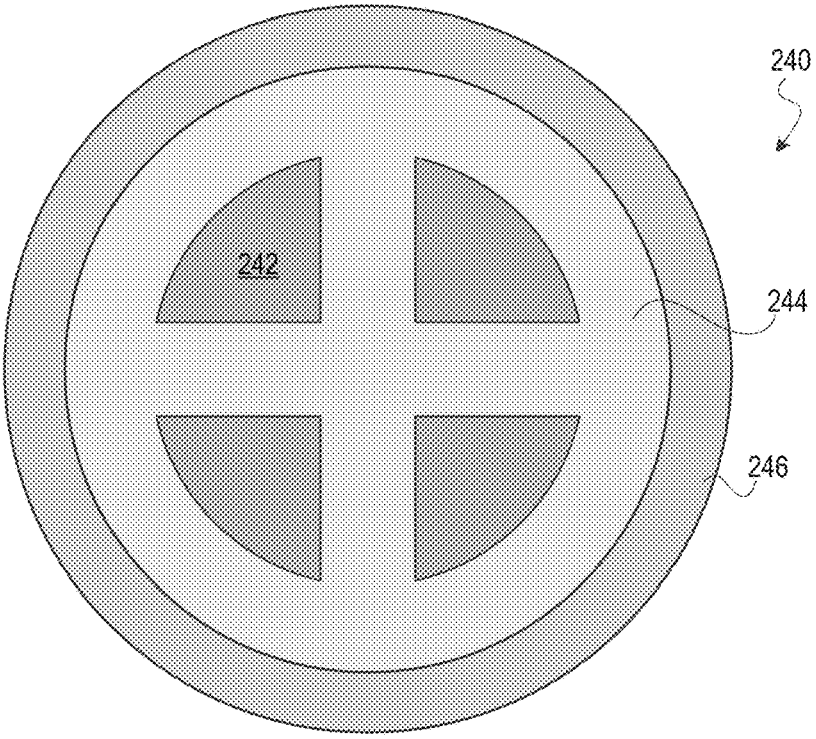
FIG. 12 is a cross-sectional view of a three-layer core, according to a first embodiment.
Figure 13:
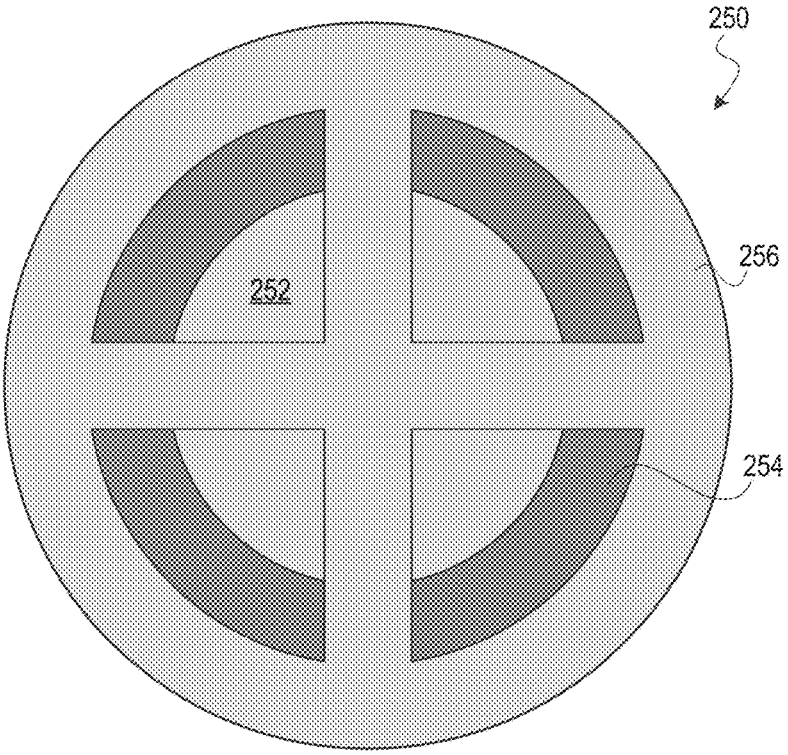
FIG. 13 is a cross-sectional view of a three-layer core, according to a second embodiment.

FIGS. 12 and 13 are examples of three-layer cores. FIG. 12, for example, includes a core 240 having an inner core 242, a first outer core 244, and a second outer core 246. FIG. 13 includes a core 250 having an inner core 252, a first outer core 254, and a second outer core 256. The cores 240, 250 are similar—the inner core 242 and inner core 252 each include two through holes. In the core 240, the composition of the first outer core 244 fills the through holes of the inner core 242. The second outer core 246 surrounds the outer surface of the first outer core 244. In the core 250, the first outer core 254 only surrounds the inner core 252 while the composition of the second outer core 256 passes through the first outer core 254 to reach and completely fill the through holes of the inner core 252. In order to make the core 250, the inner core 252 and first outer core 254 may be integrally molded into one piece and then holes formed into the combined component (i.e., drilled holes through the combined inner core and first outer core).

In the cores 240, 250 the second outer cores 246, 256 form a third core layer that may be made from a third composition. The third composition may be another core rubber formulation, different from the composition of the inner cores 242, 252, and first outer cores 244, 254. In some embodiments, the composition of the second outer core may be the same as the inner core, but both different than the composition of the first outer core.

Multi-layer cores necessarily possesses characteristics related to the relative positioning of the core layers relative to each other. Sometimes, one layer may shift relative to another layer, degrading the concentricity of the overall core. One potential cause for typical shifting of the inner core relative to the outer shell material could be the force exerted on the cured inner core by the outer core "shell" as it flows within the cavity and into the matrix during the curing cycle.

Disclosed embodiments of multi-layer cores having interlocking layers help mitigate the molding force that could cause shifting by boring holes through the molded inner core before curing the outer core. This allows the outer core material to flow through the inner core during the curing cycle rather than force the inner core to shift. Additionally, as the outer material cures, it will mechanically "lock" the inner core in place, to further prevent shifting. The outer core material may be a core rubber formulation.

In disclosed embodiments, each of the core layers may be made from a core rubber formulation. For example, the first, second, third, etc, core composition may comprise rubber compositions such as polybutadiene, ethylene-propylene rubber, ethylene-propylene-diene rubber, polyisoprene, styrene-butadiene rubber, polyalkenamers, butyl rubber, halobutyl rubber, polystyrene elastomers, and/or castable liquid rubber compositions. In an exemplary embodiment, the core rubber formulations comprise polybutadiene and have a Mooney viscosity in a range from about 30 units to about 60 units in order to promote interlocking of the core layers, via the through holes in the inner core, during molding.

Unless otherwise defined, all terms (including technical and scientific terms) used herein have the same meaning as commonly understood by one of ordinary skill in the art of this disclosure. It will be further understood that terms, such as those defined in commonly used dictionaries, should be interpreted as having a meaning that is consistent with their meaning in the context of the specification and should not be interpreted in an idealized or overly formal sense unless expressly so defined herein. Well known functions or constructions may not be described in detail for brevity or clarity.

The terms "about" and "approximately" shall generally mean an acceptable degree of error or variation for the quantity measured given the nature or precision of the measurements to one of ordinary skill in the art. Numerical quantities given in this description are approximate unless stated otherwise, meaning that the term "about" or "approximately" can be inferred when not expressly stated.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

The terminology used herein is for the purpose of describing particular embodiments only and is not intended to be limiting. As used herein, the singular forms "a", "an" and "the" are intended to include the plural forms as well (i.e., at least one of whatever the article modifies), unless the context clearly indicates otherwise.

Different materials may be used in the construction of golf balls according to the present disclosure. For example, the cover of the ball may be made of a thermoset or thermoplastic, a castable or non-castable polyurethane and polyurea, an ionomer resin, balata, or any other suitable cover material known to those skilled in the art. Conventional and non-conventional materials may be used for forming core and intermediate layers of the ball including polybutadiene and other rubber-based core formulations, ionomer resins, highly neutralized polymers, and the like.

The dimple count on the golf balls contemplated by the present disclosure may be varied. As used herein, the "dimple count" of a golf ball refers to how many dimples are present on the golf ball. The total number of dimples may be based on, for instance, the number of differently sized dimples, the maximum and minimum diameters of the dimples, the dimple arrangement, and the desired surface coverage.

In one embodiment, the total number of dimples may be less than about 350 dimples. For example, the total number of dimples on the golf ball may be about 328. In another embodiment, the total number of dimples on the golf ball may be about 344. In still another embodiment, the total number of dimples on the golf ball may be about 348.

In another embodiment, the total number of dimples on the golf ball may range from about 350 dimples to about 500 dimples. For instance, the total number of dimples may be about 352 dimples. In another embodiment, the total number of dimples may be about 388 dimples.

The golf balls described and claimed herein are not to be limited in scope by the specific embodiments herein disclosed, since these embodiments are intended as illustrations of several aspects of the disclosure. Any equivalent embodiments are intended to be within the scope of this disclosure. Indeed, various modifications of the device in addition to those shown and described herein will become apparent to those skilled in the art from the foregoing description. Such modifications are also intended to fall within the scope of the appended claims. All patents and patent applications cited in the foregoing text are expressly incorporated herein by reference in their entirety. Any section headings herein are provided only for consistency with the suggestions of 37 C.F.R. § 1.77 or otherwise to provide organizational queues. These headings shall not limit or characterize the invention(s) set forth herein.

What is claimed is:

1. A golf ball comprising:

a cover; and a core surrounded by the cover, the core comprising:

an inner core formed from a first composition and having a generally spherical shape and a spherical surface, the inner core defining one or more through holes that each extend from a first opening at the spherical surface to a second opening at the spherical surface; and an outer core formed from a second composition, different from the first composition, the outer core comprising a first portion that surrounds the inner core and a second portion that extends from the first opening to the second opening and thereby completely fills each through hole of the one or more through holes.

2. The golf ball of claim 1, wherein each of the one or more through holes passes through a core center point of the inner core such that the second composition is located at the core center point.

3. The golf ball of claim 1, wherein the first composition and the second composition are both core rubber formulations having a base rubber as an ingredient.

4. The golf ball of claim 1, wherein the one or more through holes comprises a plurality of through holes, wherein there are 2, 3, 4, 5, 6, or 7 through holes.

5. The golf ball of claim 4, wherein each through hole of the plurality of through holes has a diameter between 0.05 in, and a maximum that satisfies the following, where x is the total number of through holes in the inner core:

$$\text{Max Diameter(in.)} = 1.35 - \frac{23 + x}{25}.$$

6. The golf ball of claim 4, wherein the plurality of through holes comprises two through holes.

7. The golf ball of claim 6, wherein the two through holes are aligned with axes that are perpendicular to each other.

8. The golf ball of claim 7, wherein the two through holes each pass through and intersect at a core center point of the inner core such that the second composition is located at the core center point.

9. The golf ball of claim 4, wherein the plurality of through holes comprises seven through holes.

10. The golf ball of claim 9, wherein the seven through holes each include openings in the spherical surface, wherein adjacent openings on the surface of the inner core are equidistant from one another.

11. The golf ball of claim 1, further comprising an intermediate layer that is between the outer core and the cover, wherein the intermediate layer is a second outer core, a casing layer, or a second cover layer.

12. A method of making a golf ball, comprising:

molding an inner core in the shape of a sphere having a spherical surface;

forming a through hole into the inner core, the through hole being a hollow channel having a first opening in the spherical surface connected to a second opening in the spherical surface;

molding and curing an outer core onto the inner core such that the material making up the outer core flows into the through hole and completely fills the through hole with the material; and forming a cover around the outer core and the inner core, the cover comprising a plurality of dimples.

13. The method of claim 12, wherein the first opening is at a first pole of the sphere and the second opening is at an opposite pole of the sphere such that the through hole passes through a core center point of the sphere.

14. The method of claim 12, wherein the material making up the outer core comprises a composition having a base rubber and having a Mooney viscosity between about 30 and about 60.

15. The method of claim 12, further comprising forming a second through hole in the inner core, and wherein molding and curing the outer core causes the material making up the outer core to flow into and fill the second through hole with the material.

16. The method of claim 12, further comprising forming an intermediate layer that is between the outer core and the cover, wherein the intermediate layer is a second outer core, a casing layer, or a second cover layer.

17. A golf ball comprising:

a cover; and a core surrounded by the cover, the core comprising:

an inner core formed from a first composition and having a generally spherical shape and a spherical surface, the inner core defining at least one through hole that extends from a first opening at the spherical surface to a second opening at the spherical surface;

a first outer core formed from a second composition, different from the first composition; and a second outer core formed from a third composition, different from the second composition, wherein the first outer core surrounds the inner core and the second outer core surrounds the first outer core and the inner core; and wherein one of the first outer core or the second outer core includes a fill portion that extends from the first opening to the second opening and thereby completely fills the at least one through hole.

18. The golf ball of claim 17, wherein the fill portion is part of the first outer core and is formed from the second composition.

19. The golf ball of claim 17, wherein the fill portion is part of the second outer core and is formed from the third composition.

20. The golf ball of claim 19, wherein the fill portion extends through openings in the first outer core to reach the at least one through hole in the inner core.

* * * * *